US008397451B2

(12) United States Patent
Pirner

(10) Patent No.: US 8,397,451 B2
(45) Date of Patent: Mar. 19, 2013

(54) CEILING WIRING ACCESS POINT DEVICE

(75) Inventor: Jeff Pirner, Overland Park, KS (US)

(73) Assignee: Hepacart, Inc., Shawnee, KS (US)

( * ) Notice: Subject to any disclaimer, the term of this patent is extended or adjusted under 35 U.S.C. 154(b) by 45 days.

(21) Appl. No.: 13/159,829

(22) Filed: Jun. 14, 2011

(65) Prior Publication Data

US 2011/0308179 A1 Dec. 22, 2011

Related U.S. Application Data

(60) Provisional application No. 61/355,706, filed on Jun. 17, 2010.

(51) Int. Cl.
*E04C 2/52* (2006.01)

(52) U.S. Cl. ..... 52/220.8; 52/27

(58) Field of Classification Search ..... 52/27, 198, 52/204.1, 73, 192, 503, 220.8
See application file for complete search history.

(56) References Cited

U.S. PATENT DOCUMENTS

| | | | | |
|---|---|---|---|---|
| 4,551,577 | A * | 11/1985 | Byrne | 174/57 |
| 6,632,999 | B2 * | 10/2003 | Sempliner et al. | 174/659 |
| 7,141,744 | B2 * | 11/2006 | Cloutier | 174/650 |
| 7,507,912 | B1 * | 3/2009 | Sempliner et al. | 174/153 G |
| 7,871,079 | B2 * | 1/2011 | Dukes et al. | 277/616 |
| 8,266,854 | B2 * | 9/2012 | Reddicliffe | 52/220.8 |
| 2008/0290611 | A1 * | 11/2008 | Dukes et al. | 277/637 |

* cited by examiner

*Primary Examiner* — Mark Wendell
(74) *Attorney, Agent, or Firm* — Spencer Fane Britt & Browne LLP

(57) ABSTRACT

A ceiling wiring access point device is comprised of a frame panel that can be temporarily placed in a grid ceiling system during the installation of wire and cable into a ceiling space. The frame panel has an opening through which wire and cable may be inserted as it is threaded up into the ceiling. The internal edges of the opening are provided with roller members to provide a relative frictionless edge against which the wires may pass. Dust guards are provided at the opening to prevent debris from the ceiling area from falling to the room below.

16 Claims, 5 Drawing Sheets

CEILING WIRING ACCESS POINT DEVICE

RELATED APPLICATIONS

The present U.S. non-provisional patent application is related to and claims priority benefit to an earlier-filed provisional patent application titled CEILING WIRING ACCESS POINT DEVICE, Ser. No. 61/355,706, filed Jun. 17, 2010. The identified earlier-filed application is hereby incorporated by reference into the present application as though fully set forth herein.

FIELD OF THE INVENTION

The present invention relates to equipment used in connection with the installation of wiring, such as electrical wires, telecommunication lines, Internet cables, and so forth, in initial construction of buildings or in maintenance in existing structures.

BACKGROUND OF THE INVENTION

There exist many facilities in which a network of wires, cables and the like must be installed to provide the necessary resources to maintain operational and service functions throughout the facilities, such as electricity, telecommunications, Internet access. Such networks typically are required to be installed in ceilings and walls to keep them out of the way and conceal them from view.

During the installation of such wires and cables, it is frequently necessary to feed long lengths through limited access areas in the ceilings and walls. This task typically requires at least two persons, one to feed the length of wire up through the access area, and at least one other person in the ceiling or wall to pull the wire along to its ultimate placement. This is not generally an efficient use of manpower, and ties down extra workers for a marginally useful task to which they otherwise could be put to useful purpose in some other function.

SUMMARY OF THE INVENTION

The present invention comprises a device for assisting in inserting and pulling cable through a restricted access point in a barrier, such as a ceiling or wall area. One embodiment of the invention is used in connection with installing wire and cable up and through a grid ceiling, and provides for a temporary access frame member with the dimensions of a standard ceiling tile adapted to fit in a quadrant of a typical ceiling grid structure. A typical ceiling tile size is generally standard in dimension, typically 24" by 24", or 24" by 48". The temporary access frame member comprises an opening adapted to receive and guide the wire to be threaded into the ceiling area. One ceiling tile is temporarily removed from the ceiling grid system and the access frame member is put in place of the removed ceiling tile. Wire is then threaded through the opening in the access frame member and pulled on through the ceiling area as required.

In accordance with a further aspect, the access frame member comprises roller members placed in proximity to the internal edges along the opening that help to reduce friction from the wire as it is being pulled up into the ceiling or wall area.

In accordance with yet another aspect, the access frame member comprises guard members to prevent debris from the ceiling or wall from entering the area from which the wire is being pulled.

In accordance with yet another aspect, the access frame member comprises an access opening whose dimensions are adjustable.

In accordance with yet another aspect, the access frame member comprises supplemental supports for enabling independent suspension from a ceiling.

These and other features, aspects and advantages of the present teachings will become better understood with reference to the following description, examples and appended claims.

BRIEF DESCRIPTION OF THE DRAWING FIGURES

Those of skill in the art will understand that the drawings, described below, are for illustrative purposes only. The drawings are not intended to limit the scope of the present teachings in any way.

DETAILED DESCRIPTION OF THE INVENTION

With reference to the drawings figures, a ceiling wire access point device is herein described, shown, and otherwise disclosed in accordance with various embodiments, including a preferred embodiment, of the present invention.

Figure 1:
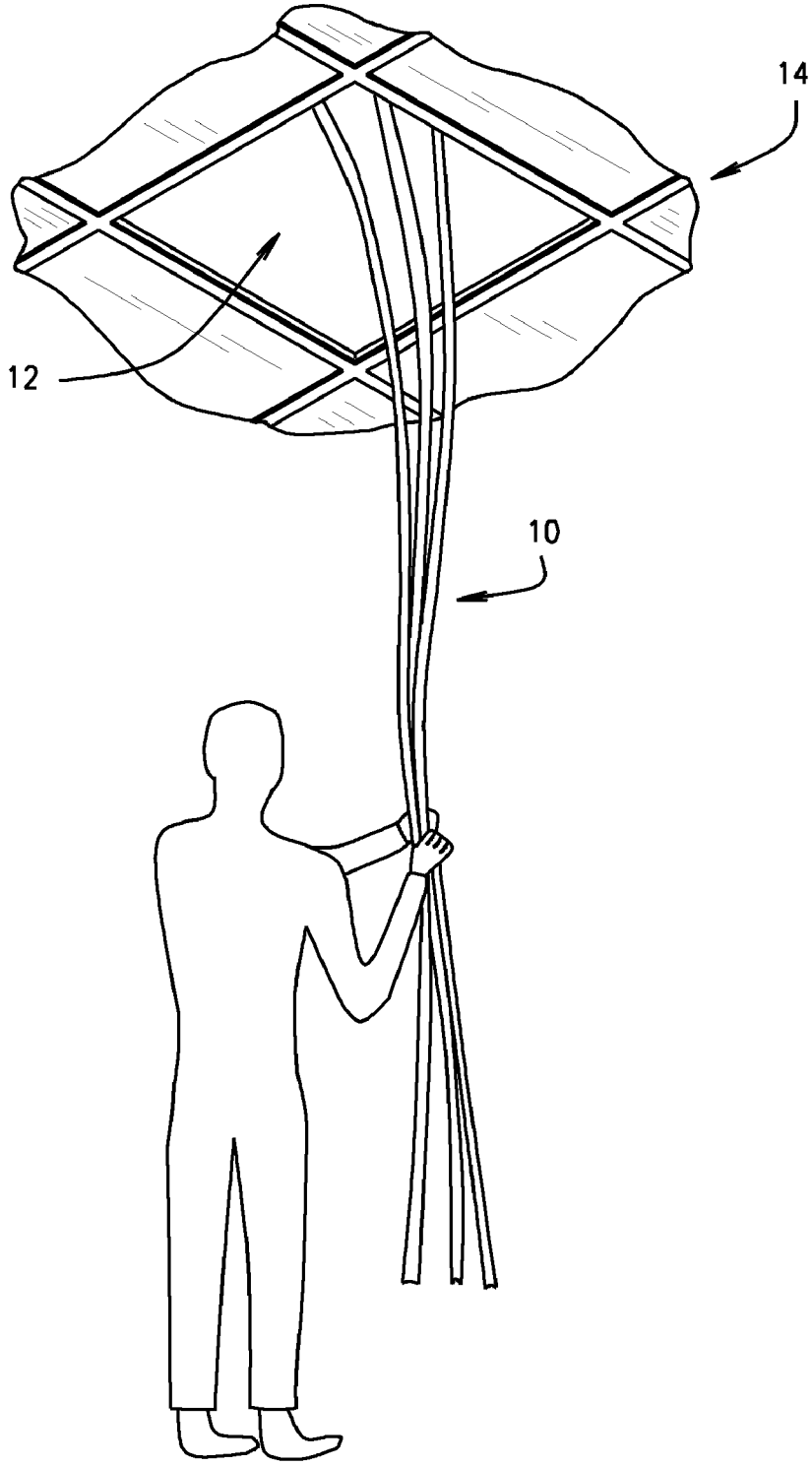
FIG. 1 is a perspective view of a person assisting in the installation of cable wiring up into a grid ceiling.

Generally, when wire or cable 10 is installed in a ceiling area 12, one person typically must remain on the floor in the room below to feed cable 10 up into the ceiling area 12 as shown in FIG. 1. Throughout the rest of the specification and claims, wire and cable, and any other type of line, are generally referred to collectively as wiring. Ceiling area 12 typically has a grid ceiling tile system 14, and one or more ceiling tiles must be removed in order to provide an opening access up to ceiling area 12.

Figure 2:
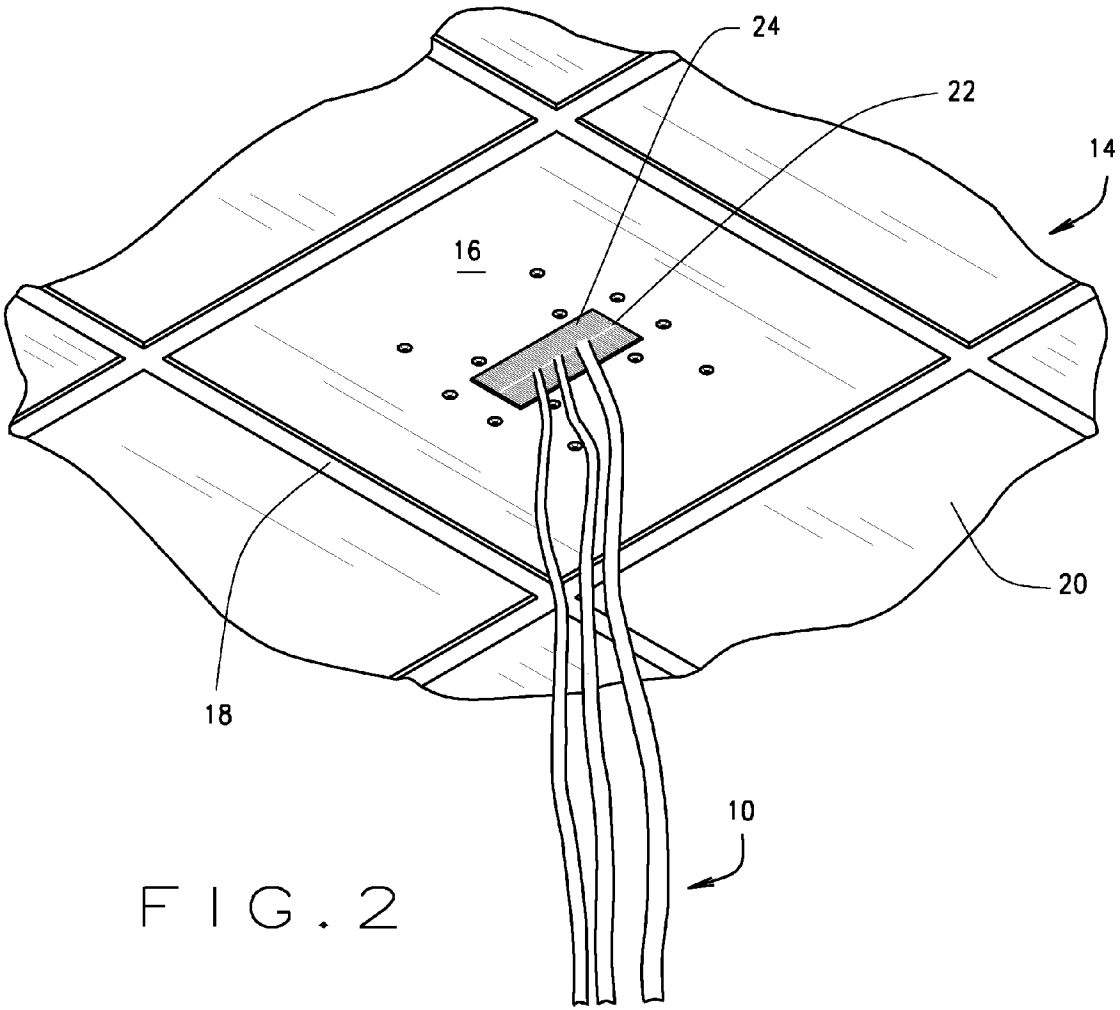
FIG. 2 is a perspective view of wiring being pulled up into the ceiling through the temporary access frame member of one embodiment of the invention.
Figure 3:
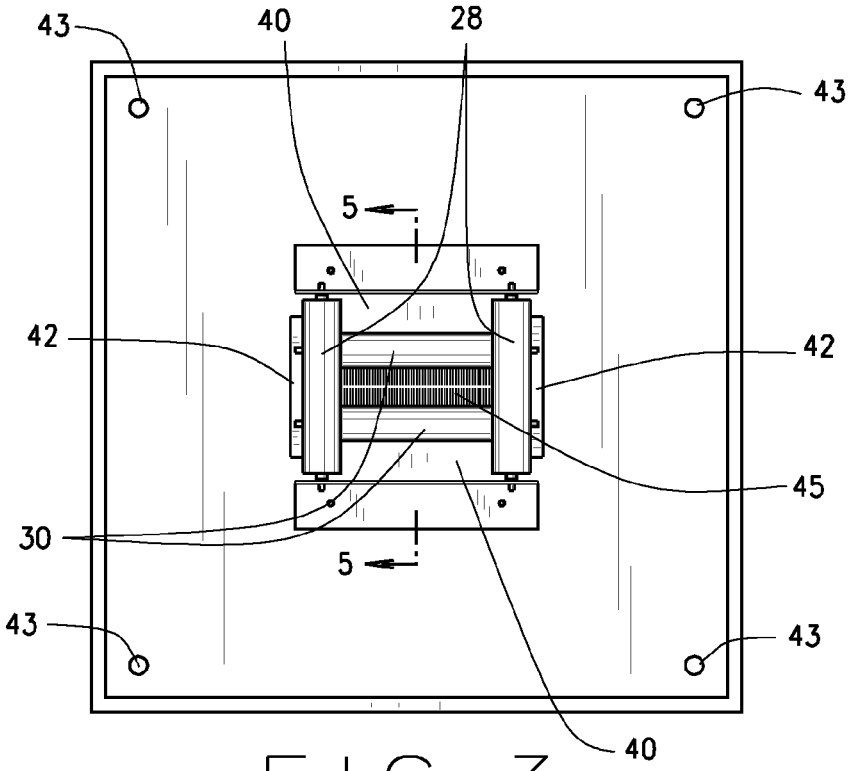
FIG. 3 is a top plan view taken from the top of the temporary access frame member of one embodiment of the invention.
Figure 4:
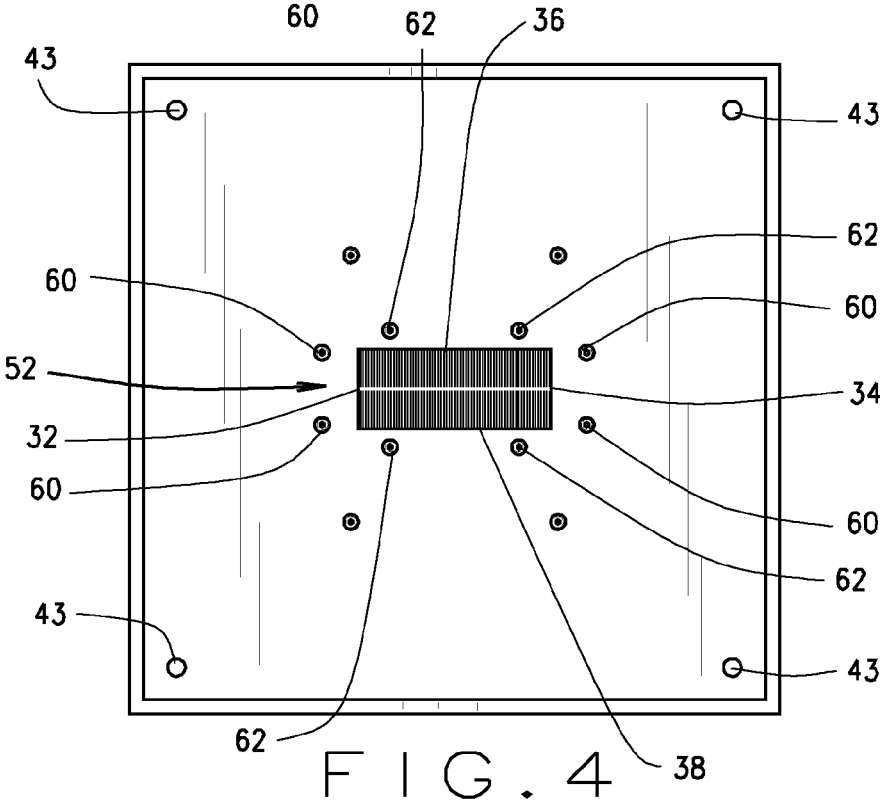
FIG. 4 is a plan view taken from the bottom of the temporary access frame member of one embodiment of the invention.
Figure 5:
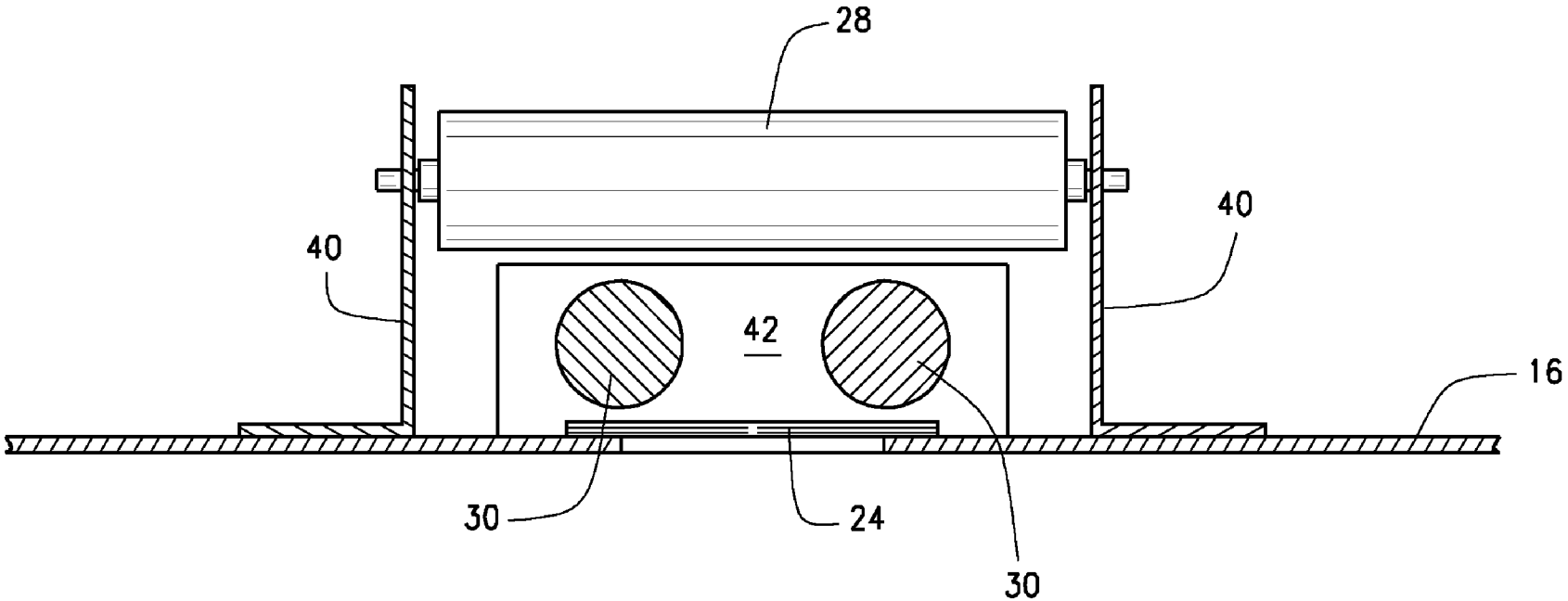
FIG. 5 is a cross-sectional view in side elevation taken along Lines 5-5 in FIG. 3.
Figure 7:
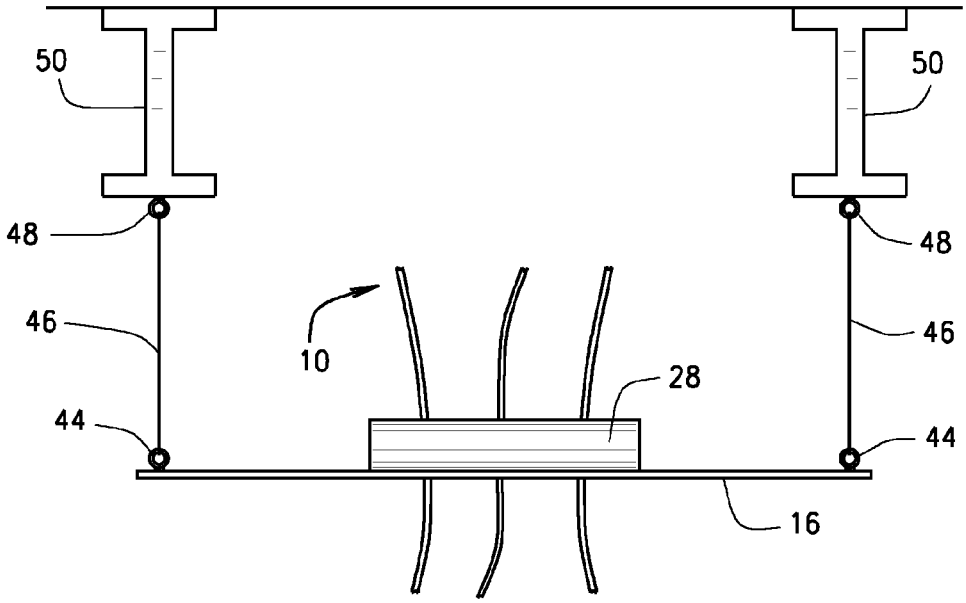
FIG. 7 is a view in side elevation taken from the side of the temporary access frame member as being supported from ceiling structure.

An embodiment of the present invention provides for a frame member 16 which may be temporarily installed in one of the grid sections 18 in place of the ceiling tile removed. As shown in FIG. 2, frame member 16 is sized to have dimensions approximating the size of a standard ceiling tile 20 which is generally either 24 inches square or 24 inches by 48 inches rectangular. Frame member 16 serves as a shield to block debris from falling from the ceiling area to the room below while the wiring is pulled through. It may comprise a flat panel which may be simply placed within and rest on the grid framework in the same manner as a standard unit of tile ceiling. It may be desirable to provide supplemental wire supports so that frame member 16 may be suspended from the ceiling structure itself as shown in FIG. 7. Holes 43 may be provided at the corners of frame member 16 as shown in FIGS. 3 and 4 to accommodate eye bolts 44 shown in FIG. 7. Hanger wire 46 extends between eye bolts 44 and appropriate connection points 48, such as eye bolts, on ceiling beams 50 to provide supplemental support to frame member 16 during the installation of wiring 10.

Frame member 16 defines an opening 22 through which cables 10 can pass as shown in FIG. 2. By having frame member 16 approximate the size of a standard ceiling tile, its temporary placement in the grid ceiling tile system 14 helps to retain dust and debris in the ceiling area that is generated by the disruption of the passing cable and the presence of workers installing and maintaining the cable in the ceiling area from falling to the room below. Additionally, dust guards 24 may be positioned at the internal edges of opening 22 to act as a screen and further help keep debris from falling to the room below. Dust guards 24 may be comprised of brush members or may be any flexible fabric that can effectively serve as a screen to minimize the falling of debris. FIG. 4 shows brush bristles 52 anchored on opposing edges 36 and 38 of opening 22. To maximize the efficiency of brush bristles 52 in keeping debris from falling from the ceiling area, the bristles should cover opening 22 as much as possible. Because brush bristles are relatively flexible, it is further advantageous to have opposing brush bristle ends intermesh so that opening 22 is completely covered. The area where the brush bristle ends intermesh and overlap is flexible and permits passage of wiring therethrough while minimizing the escape of debris.

To permit wire and cable to be guided smoothly through frame member 16 and prevent the wire and cable from snagging, a further embodiment has a series of roller members disposed along the edges of opening 22. FIG. 3 shows an arrangement of rollers mounted in proximity to the edges of opening 22. In this particular configuration, a first pair of rollers 28 are disposed parallel to each other at edges 32 and 34 of opening 22, and a second pair of parallel-disposed rollers 30 are positioned at edges 36 and 38. Bracket members 40 support rollers 28 and bracket members 42 support rollers 30. By this arrangement, all edges comprising opening 22 will be provided with a roller element thereby reducing the potential for drag on the cable as it is pulled upward through frame member 16. In other embodiments, the edges of opening 22 may be provided with other friction-reducing surfaces besides roller members.

Figure 6:
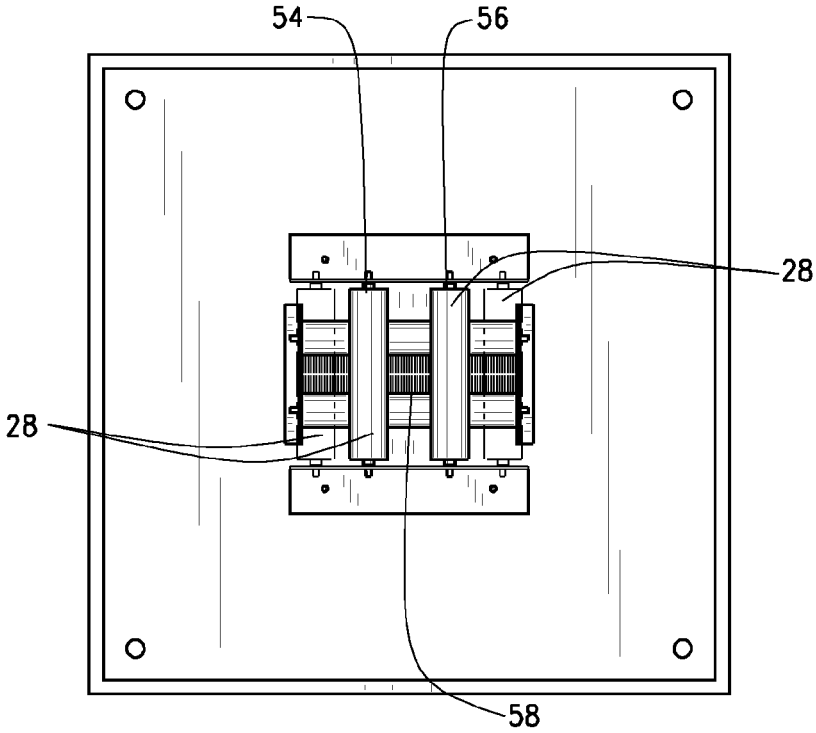
FIG. 6 is top plan view, similar to FIG. 3, taken from the top of the temporary access frame member of one embodiment of the invention, and showing the roller members partially in phantom.

In the embodiment described, the effective dimension of opening 22 for the passage of wiring 10 is dependent on the relative spacing of the respective roller pairs 28 and 30. As can be seen in FIG. 3, the relative positioning of roller pair 28 with respect to roller pair 30 defines a specific area 45 to provide a particular dimension to opening 22 for that specific positioning. The area dimension of opening 22 can be adjusted by moving one or more of the roller elements among the roller pairs 28 and 30. As seen in FIG. 6, individual roller elements 54 and 56 of roller pair 28 may be moved inwardly from an outer first position resulting in a decreased area 58 of opening 22. Various mechanisms well known to those skilled in the art can be employed for effecting the adjustability of the spacing of the roller pairs. The bracket members may be provided with spaced holes for receiving the ends of the roller elements, such that different positioning of the roller members in different holes affects the dimension of opening 22. Alternatively, an elongated slot may be provided in the bracket and the positioning of the roller member may be controlled by sliding along the slot. Yet another alternative is to provide alternate spaced holes 60 and 62 for placement of the brackets at different positions. These various alternatives effectively place the roller members at varying distances with respect to each other thereby adjusting the dimension of opening 22.

In another embodiment, opening 22 may comprise a circular or other shape opening dependent upon the configuration of the friction-reducing elements.

In another embodiment, the device may be adapted for use with other barriers, such as a wall access area where wiring is pulled from one room into another. In that situation, frame member 16 may simply be bolted or otherwise connected to an opening in a wall. Wiring can then be pulled from one room to another through the frame member in the same manner, and with similar efficiency, as when used in the ceiling context.

Although the invention has been disclosed with reference to various particular embodiments, it is understood that equivalents may be employed and substitutions made herein without departing from the scope of the invention as recited in the claims.

Having thus described the preferred embodiment of the invention, what is claimed as new and desired to protected by Letters Patent includes the following:

1. A device through which wiring is drawn from one side of a barrier to another side, where the barrier has an access area for receiving the wiring, the device comprising a frame member adapted for mounting at the access area in the barrier, the frame member further comprising:

a. a shield portion;

b. an opening for receiving wiring therethrough;

c. a friction-limiting guide member; and d. a screen member, the shield portion extending inwardly from edges of the frame member and being adapted to substantially cover the access area, the opening being disposed in the shield portion to permit communication between each side of the barrier, the friction-limiting guide member being disposed around the opening for receiving wire whereby the wiring can contact the guide member as it is pulled through the barrier to facilitate the passing of the wire, the screen member being disposed about the opening to restrict the passage of debris through the barrier while the wiring is being drawn through the access area.

2. The device of claim 1 in which the shield portion comprises a flat panel.

3. The device of claim 1 in which the dimension of the opening is adjustable.

4. The device of claim 1 in which the friction-limiting guide member comprises roller members.

5. The device of claim 4 in which a position of the roller members with respect to the opening is adjustable whereby a dimension of the opening is adjustable through a re-positioning of at least one roller member over the opening.

6. The device of claim 1 in which the screen member comprises brush members disposed around an edge of the opening.

7. The device of claim 6 in which the brush members are oriented such that opposing ends of the brush members contact and mesh with each other to form a flexible passageway along points where the opposing ends of the brush members contact each other through which the wiring is pulled.

8. The device of claim 1 in which the device is adapted for mounting at an access area of a barrier comprising a ceiling.

9. The device of claim 1 in which the device is adapted for mounting at an access area of a barrier comprising a wall.

10. A ceiling panel access device for pulling wiring from a lower area up in to a ceiling area, where the ceiling comprises a grid ceiling system, the ceiling panel access device comprising:

a. a shield portion;

b. an opening for receiving wiring therethrough;

c. friction-limiting guide members; and d. a screen member;

the shield portion comprising a panel having a dimension of a standard ceiling tile adapted to fit within a grid unit of a standard grid ceiling system, the opening being disposed in the shield portion to permit communication from the area beneath the ceiling through to the ceiling area, the friction-limiting guide member being disposed around the opening for receiving wire whereby the wiring can contact the guide member as it is pulled up into the ceiling area to facilitate the passing of the wire, the screen member being disposed about the opening to restrict the passage of debris from the ceiling area to the lower area beneath the ceiling while the wiring is being drawn up into the ceiling area.

11. The ceiling panel access device of claim 10 being adapted for suspension from a structure independently from the grid ceiling system.

12. The ceiling panel access device of claim 10 in which the dimension of the opening is adjustable.

13. The ceiling panel access device of claim 10 in which the friction-limiting guide member comprises roller members.

14. The ceiling panel access device of claim 13 in which a position of the roller members with respect to the opening is adjustable whereby a dimension of the opening is adjustable through a re-positioning of at least one roller member over the opening.

15. The ceiling panel access device of claim 10 in which the screen member comprises brush members disposed around an edge of the opening.

16. The ceiling panel access device of claim 15 in which the brush members are oriented such that opposing ends of the brush members contact and mesh with each other to form a flexible passageway along points where the opposing ends of the brush members contact each other through which the wiring is pulled.

* * * * *